US005393055A

United States Patent [19]

MacKay, Jr.

[11] Patent Number: 5,393,055

[45] Date of Patent: Feb. 28, 1995

[54] BALL BAT WITH CONCENTRATED WEIGHT LOAD AND METHOD OF MAKING SAME

[76] Inventor: Jack W. MacKay, Jr., Rte. 9, Box 185, Mt. Pleasant, Tex. 75455

[21] Appl. No.: 105,924

[22] Filed: Aug. 13, 1993

[51] Int. Cl.[6] ..... A63B 59/06

[52] U.S. Cl. ..... 273/72 A; 273/26 B

[58] Field of Search ..... 273/72 R, 72 A, 26 B, 273/DIG. 20

[56] References Cited

U.S. PATENT DOCUMENTS 1,499,128 6/1924 Shroyer, Jr. .
1,611,858 12/1926 Middlekauff ..... 273/72 R
3,116,926 1/1964 Owen et al. ..... 273/72
3,955,816 5/1976 Bratt ..... 273/26 B
3,963,239 6/1976 Fujii ..... 273/72 A
4,241,919 12/1980 Foreman ..... 273/72 A
4,763,899 8/1988 Hundley ..... 273/26 B
4,844,460 7/1989 Mitchell et al. ..... 273/72 R
5,114,144 5/1992 Baum ..... 273/72 R

*Primary Examiner*—William H. Grieb
*Attorney, Agent, or Firm*—Jacobson, Price, Holman & Stern

[57] ABSTRACT

A hollow barrel with a concentrated weight load oriented at the end of the bat adjacent the ball striking zone and the method of making the bat.

19 Claims, 3 Drawing Sheets

BALL BAT WITH CONCENTRATED WEIGHT LOAD AND METHOD OF MAKING SAME

BACKGROUND OF THE INVENTION

1. Field of the Invention

The present invention relates to baseball and softball bats, and more particularly to a bat having a hollow barrel with a concentrated weight load oriented at the end of the bat adjacent the ball striking zone and the method of making the bat.

2. Description of the Prior Art

The idea of adding weight to the end of a ball bat to increase the inertia of the bat as it is swung at a ball is known per se. Traditionally, with wooden ball bats the weight distribution was controlled by selecting a circumference of the ball striking zone which provided a predetermined weight distribution. Also, with wooden ball bats, it was known to drill out a hole in the end of the bat and to insert a weight in the bored out hole.

With hollow metal ball bats, one way that the weight distribution is controlled is by making the wall of the bat barrel thinner or thicker. Another known way that the weight distribution is controlled is by placing a material inside the bat barrel.

The following U.S. patents are exemplary of the various methods for increasing the weight toward the ball striking end of the bat.

U.S. Pat. No. 1,499,128 issued on Jun. 24, 1924 to W. A. Shroyer discloses a hollow metal baseball bat having an internally threaded aperture or bore at the end of the bat with a cylindrical weight element threaded into the bore in the bat end to regulate the weight balance of the bat. To adjust or change the weight balance of the bat to suit different players, the weight can be cut to any suitable length before it is installed in the bore at the bat end.

U.S. Pat. No. 3,116,926 issued on Jan. 7, 1964 to A. M. Owen et al. discloses a wooden bat having an end of the bat drilled out to form a chamber. A compression spring is installed in the chamber and weights are inserted into the chamber above the spring. The open end of the chamber is closed by an end cap so that the spring biases the weights against the end cap. The length and number of weights can be varied in accordance with the desired amount of weight to be added to the bat.

U.S. Pat. No. 3,955,816 issued on May 11, 1976 to Leonard R. Bratt discloses a warm-up bat comprised of a bat handle fastened to one end of a weight chamber structure. The end of the weight chamber structure opposite the handle is closed by an end plug threaded into the end of the chamber structure. The weight chamber structure is filled with weighted material such as sand. The weight of the warm-up bat can be changed by increasing or decreasing the amount of sand in the chamber structure.

U.S. Pat. No. 3,963,239 issued on Jun. 15, 1976 to Hirokazu Fujii discloses a hollow metal bat having a weight installed into the hollow batting or ball striking portion of the bat. The weight can be a cylindrical plug, a hollow cylinder, a coil spring or a helical member. The open end of the bat is closed by an end cap. The weight of the bat can be changed by installing a weight insert of different size and weight.

U.S. Pat. No. 4,241,919 issued on Dec. 30, 1980 to Ronald Foreman discloses a hollow metallic baseball bat having an open end closed and sealed by a rubber resilient end plug. The pressure of the air inside the hollow space of the bat is modified to attain the optimum pressure, either above or below atmospheric pressure, inside the bat to enable the bat to vibrate at critical structural frequency to thereby impart resonance conditions upon the ball when the ball is struck by the bat.

U.S. Pat. No. 4,744,136 issued on May 17, 1988 to Ronald Foreman discloses a hollow metallic bat having a rubber weight plug located inside the bat at the end of the bat. The weight plug has a protruding portion which further secures the plug in place. The plug is forced into the end of the bat with a compression fit, and the end of the bat is spun down to partially close the end of the bat but leaving a central opening at the end of the bat through which the protruding portion of the plug extends. The interior of the bat is then pressurized with compressed air which forces the plug along the bat pushing the protruding portion of the plug through the central opening of the spun down end of the bat further securing the plug in place without the use of adhesive.

U.S. Pat. No. 4,763,899 issued on Aug. 16, 1988 to W. Maynard Hundley discloses a warm-up bat fabricated of a moldable polyurethane material which is flexible and resilient. An elongated stiffener rod with a weight attached at one end is molded in the polyurethane material of the bat.

U.S. Pat. No. 4,844,460 issued on Jul. 4, 1989 to Hal D. Mitchell et al. discloses a wooden ball bat which is formed of two pieces, each pieces is formed with a recess at a selected position along its length. The two pieces of the bat are located in side-by-side position with each other such that the recesses are in alignment with each other combing to form a void inside the bat barrel when the two pieces are glued together. The size and position of the void along the bat barrel determines the weight and center of gravity of the bat.

The above-mentioned patents all teach that the weight distribution of the bat can be increased or decreased by increasing or decreasing, respectively, the size or volume of the weight material added at the end of the bat. However, as the size or volume of the weight material added to the bat is increased to increase the weight, the weight material extends into the interior of the hollow bat barrel in the ball striking zone and adversely interferes with the wall of the bat barrel when the ball strikes a ball.

The above-mentioned patents do not disclose the novel concept of the present invention of providing a weight material at the ball striking end of the bat barrel which forms a concentrated weight load at the end of the bat barrel which weight can be increased without increasing the volume of the added weight material thereby providing a concentrated weight load oriented axially outwardly of the ball striking zone so that the short length of the added weight material will not interfere with the wall of the ball barrel from flexing inwardly when a ball is struck which is essential to maintain maximum velocity of the ball as it leaves the bat thereby obtaining maximum distance of ball travel.

SUMMARY OF THE INVENTION

An object of this invention is to overcome the drawbacks of the heretofore known bats which have added weight toward the end of the bat barrel and provides a solution which allows for more weight material to be added to the bat end without the adverse effect of the added weight material extending into engagement with the interior surfaces of the bat barrel in the ball striking zone.

Another object of the invention is to provide a baseball bat having novel added weight material construction at the ball striking end of the bat which provides for increasing and/or decreasing the amount of weight without the added weight material extending into the ball striking zone of the bat.

More particularly, the present invention provides a hollow metallic ball bat comprising a hollow generally cylindrical bat barrel having a handle end and a ball striking end with a ball striking zone located adjacent the ball striking end and a hand grasp zone of smaller circumference than the ball contact zone located adjacent the handle end, a volume of a first material cast in the bat barrel immediately adjacent the end of the barrel, and a plurality of discrete particles of a second material having a greater specific weight than the first material dispersement throughout the volume of the first material in the end of the bat barrel sufficient to provide a predetermined concentrated weight load immediately adjacent the ball striking end of the bat barrel with the inner end portion of the added weight material terminating axially outwardly of the ball striking zone of the bat barrel.

The present invention further provides a method of making a ball bat as described which comprises the steps of forming a hollow bat barrel, forming a predetermined amount of a castable first material to be cast in the hollow barrel at the ball striking end in which the volume of material has an inner end spaced outwardly of the ball striking zone of the bat barrel, assembling a predetermined summed weight of individual discrete particles of a second material of greater specific weight than the first material, inserting the assembled particles into the bat barrel for dispersement in a pattern balanced about a longitudinal axis throughout the volume of first material to provide a predetermined total concentrated weight load consisting of the weight of first material and second material, and allowing the first material to solidify insitu in the hollow bat barrel at the ball striking end thereof and in spaced relation to the ball striking zone thereof.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
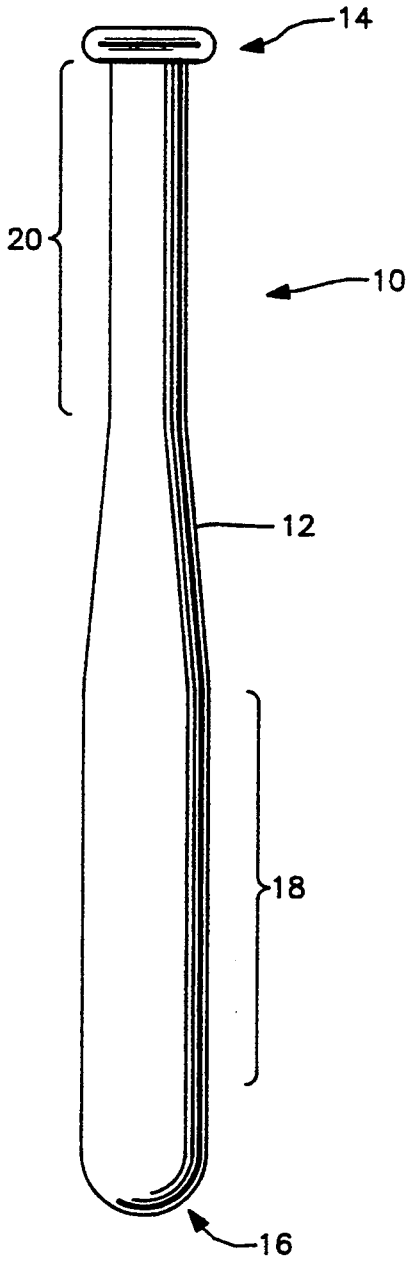
FIG. 1 is a side elevational view of a ball bat in which the features of the present invention may be incorporated.

The baseball and/or softball bat 10 of this invention is of conventional configuration and size and includes a hollow generally cylindrical bat barrel 12 having a handle end 14 and a ball striking end 16 with a ball striking zone 18. The handle end includes a gripping area 20, usually having a smaller circumference than the ball striking zone 18. The bat barrel 12 is preferably fabricated of a metal, for example, aluminum. Previously in forming a bat from a hollow tube which has been formed with a bat shape by swaging or other conventional practices is provided with hardenable polyurethane or similar material of sufficient volume and weight to bring the bat to a desired total weight. For example, a bat which is formed with the wall thickness desired for optimum flexing in the ball striking zone to obtain maximum ball velocity when struck will weigh about 25–27 ounces. In order to obtain a total weight of 32–34 ounces, 5–7 ounces of polyurethane was added which occupied about 6 inches of the outer end of the bat with the inner end of the added material extending into and engaging the inner surface of the bat barrel in the ball striking zone. This engagement prevents inward deflection or flexing of the wall of the bat barrel and reduces the natural reaction force against the ball when the flexed wall returns to its original shape.

Figure 2:
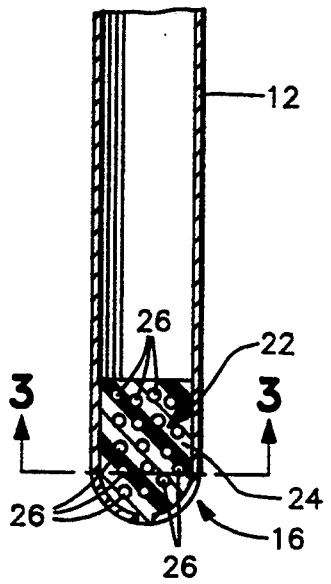
FIG. 2 is a partial longitudinal sectional view of a ball bat showing details of an embodiment of the present invention.
Figure 3:
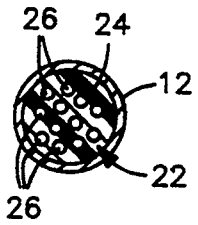
FIG. 3 is a transverse sectional view of the bat taken along section line 3—3 in FIG. 2 showing additional details of the structure shown in FIG. 2.

FIGS. 2 and 3 illustrate the present invention which includes a novel concentrated weight load 22 in the bat barrel 12 having a volume located immediately adjacent the ball striking end 16 and spaced from the ball striking zone which allows the wall of the bat barrel to flex in a normal manner without interference from the concentrated weight load 22 of this invention. This also provides for increasing and/or decreasing the weight of the weight load 22 without materially changing the volume of the weight load 22 relative to the end 16 of the bat barrel 12. Further, the inertia generated by the weight load 22 for any given weight is maximized because the weight load 22 is located as close as practical to the end 16 of the bat barrel. The weight load 22 comprises a volume of a first castable material 24, such as polyurethane, in the bat barrel 12 immediately at the end 16 of the bat barrel 12, and a plurality of discrete individual particles 26 of a second material, such as metal, dispersed in a balanced pattern about a longitudinal axis throughout the volume of the first material 24. The second material of the particles 26 has a greater specific weight than that of the first material 24. For a given volume of castable first material 24, the amount of particles 26 disbursed throughout the first material is preselected to produce a summed weight of particles 26 sufficient to provide a predetermined total weight (consisting of the weight of the first material 24 and particles 26) to be added to the bat to suit the desires of a batter. For example, where the polyurethane added in previous bats is about 6 inches long, the material 24 in this invention is about 1 inch in length and preferably not over 1½ inches when the heavier particles 26 have been added thereto and the hardenable polyurethane completely encapsulates the particles of lead, steel or other heavier material. To increase or decrease the total weight of the weight load 22, it is a simple matter to reduce or increase the amount of first material 24 to compensate for the increased volume consumed by the increased number of particles 26 thereby maintaining a constant total volume of space taken up by the weight load 22 in the bat barrel. Therefore, regardless of the total weight of the weight load 22, the total volume of the weight load 22 will remain substantially the same. By providing a jig of polyurethane connected with the particles 26 and projecting outwardly of the particles 26, they can be retained throughout the volume of the polyurethane 24 such that each of the particles 26 is encased within the volume of the first material 24 so that each particle 26 is surrounded by first material 24 and there is an amount of the first material 24 between the interior surface 28 of the bat barrel 12 and the particles 26 adjacent the interior surface 28 of the bat barrel 12 so that there is no contact between the interior surface 28 of the bat barrel 12 and the particles 26. The particles 26 can be of virtually any shape or geometrical configuration such as, for example, spherical, conical, triangular, cubical, toroidal or the like. As illustrated, the particles are in a pattern that is balanced about a longitudinal axis so that inertial torque forces are not present when the bat strikes the ball.

Figure 4:
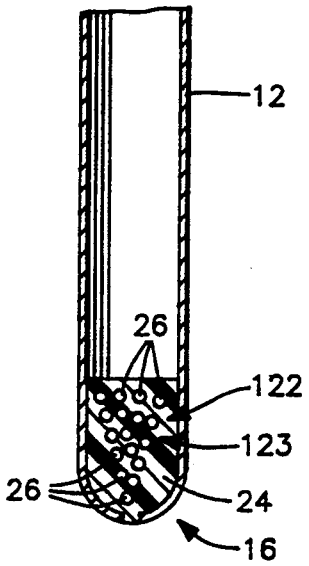
FIGS. 4–9 are longitudinal sectional views similar to FIG. 2 but illustrating additional embodiments.
Figure 5:
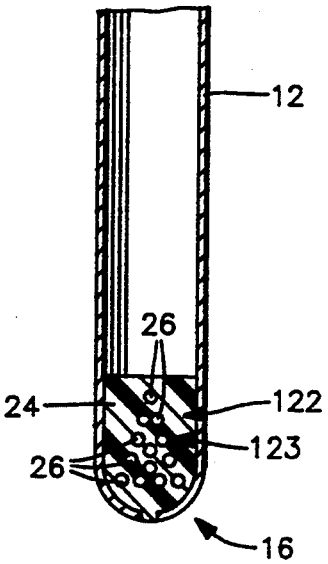
Figure 6:
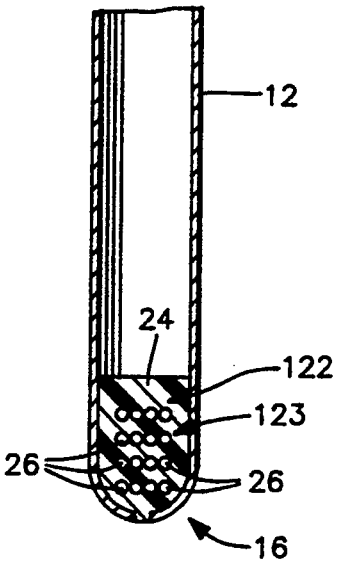
Figure 7:
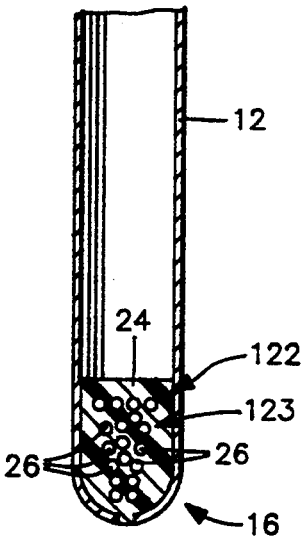
Figure 8:
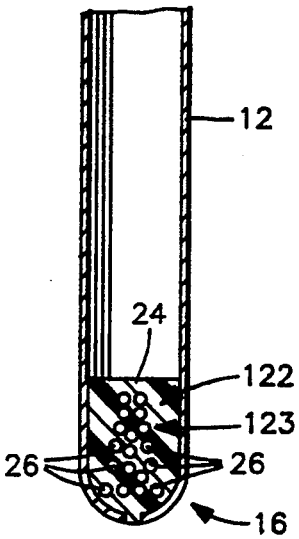
Figure 9:
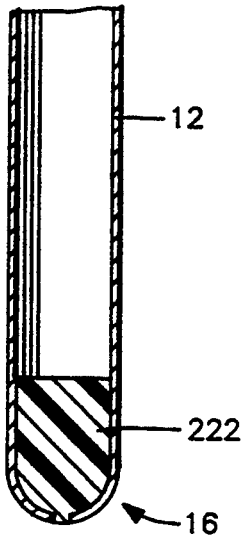

FIG. 4 illustrates another embodiment of the concentrated weight load 122 included in the bat barrel 12 immediately adjacent the end 16 which allows for increasing and/or decreasing the total weight of the weight load 122 without changing the total volume of the weight load 122 in the same manner as weight load 22 in FIGS. 2 and 3. The individual particles 26 in this embodiment are arranged or organized to occupy or consume a geometrically shaped volume 123 within the first material 24 as opposed to being disbursed throughout the volume of the first material 24 as in the embodiment of FIGS. 2 and 3. The geometrically shaped volume 123 occupied by the individual particles 26 is conical and concentric with the bat barrel 12, and with the apex of the conical volume 123 adjacent the end 16 of the bat. FIG. 5 illustrates the conically shaped volume 123 in which the apex of the conical volume 123 is pointed toward the handle end 14. FIG. 6 illustrates the geometrically shaped volume 123 occupied by the individual particles 26 as being cylindrical and concentric with the bat barrel 12. FIG. 7 illustrates the geometrically shaped volume 123 as being a truncated cone concentric with the bat barrel 12 with the truncated apex pointed toward the end 16. FIG. 8 illustrates the geometrically shaped volume 123 occupied by the individual particles 26 as being a truncated cone concentric with the bat barrel 12 with the truncated apex pointed toward the handle end 14. FIG. 9 illustrates a concentrated weight load 222 in the form of a solid metal end formed in the end 16 of the bat barrel.

The ball bat 10 is formed by a known process with the circumference of the ball striking zone 18 larger than the circumference of the hand gripping area 20. However, the end 14 of the bat is left in open condition by omitting the knob to enable insertion of the weight load 22. A total weight to be added to the bat barrel 12 is than determined. Bats of different weights can be made to suite the preferences of different ball players. A predetermined amount of the first material 24 to be cast into the ball barrel 12 is poured or otherwise deposited in the open end 14 of the bat 10 which is oriented in vertical position and this material flows to the end 16 of the bat. A predetermined summed weight of individual discrete particles 26 of the second material is accumulated such that the total weight consisting of the weight of the volume of first material 24 and particles 26 totals the predetermined weight to be added to the bat barrel 12, and the individual discrete particles 26 which may be connected by a jig (not shown) which is sufficiently flexible to enable the assembly to be inserted through the open end 14 of the bat and hold the particles 26 dispersed throughout the volume of the first material as it solidifies or the particles may be inserted by dropping them into material 24. The open end 14 is then closed by welding the knob in place. The solid metal end may be inserted and attached during the process of closing the end of the bat 16 or may be monolithic or unitary with the bat barrel.

The foregoing detailed description is given primarily for clearness of understanding and no unnecessary limitations are to be understood therefrom for modifications will become obvious to those skilled in the art and may be made without departing from the spirit of the invention and scope of the appended claims.

What is claimed as new is as follows:

1. A hollow metallic ball bat having a hollow generally cylindrical tapered bat barrel of one-piece construction defined by a peripherally continuous wall having a handle end and a closed ball striking end with a ball striking zone located adjacent the ball striking end and a hand grasp zone of smaller circumference than the ball striking zone located adjacent the handle end, a concentrated weight load incorporated into and in direct contact with an inner surface of the closed end of the bat barrel immediately adjacent the ball striking end of the barrel, said concentrated weight load having an inner end spaced from the closed end of the bat barrel and spaced axially outwardly of the ball striking zone to preclude the concentrated weight load from interfering with flexing of the wall of the bat barrel when the ball striking zone strikes a ball.

2. The bat of claim 1, wherein the concentrated weight load has an inner end spaced about 1 to 1½ inch from the outer end of the ball striking end of the bat whereby the weight load will not interfere with inward flexing of the wall of the bat barrel in the ball striking zone when a ball is struck to obtain maximum ball velocity.

3. The bat of claim 1, wherein said weight load is solid metal material rigid with the interior of the bat.

4. In a hollow metallic ball bat having a hollow generally cylindrical tapered bat barrel defined by a wall having a handle end and a ball striking end with a ball striking zone located adjacent the ball striking end and a hand grasp zone of smaller circumference than the ball striking zone located adjacent the handle end, the improvement comprising a concentrated weight load incorporated into the bat barrel immediately adjacent the ball striking end of the barrel and spaced axially outwardly of the ball striking zone to preclude the concentrated weight load from interfering with flexing of the wall of the bat barrel when the ball striking zone strikes a ball, said concentrated weight load including a hardenable material placed in the bat barrel when in a flowable state and a plurality of discrete particles of material having a greater specific weight than the hardenable material generally uniformly distributed within the volume of said hardenable material concentrically about the longitudinal axis of the bat.

5. The bat of claim 2, wherein each of the particles is encapsulated within the volume of the hardenable material.

6. The bat of claim 5, wherein each of the particles is surrounded by said hardenable material.

7. The bat of claim 6, wherein there is an amount of the hardenable material between the interior surface of the bat barrel wall and the particles.

8. The bat of claim 4, wherein the number of particles may be varied without substantial variation in the volume of, the hardenable material.

9. The bat of claim 4, wherein the particles are dispersed throughout the volume of the hardened material in a pattern balanced about a longitudinal axis.

10. The bat of claim 9, wherein said particles are organized to occupy a geometrically shaped volume.

11. The bat of claim 10, wherein the geometrically shaped volume occupied by the particles is a cone.

12. The bat of claim 11, wherein the cone shaped volume is oriented with the apex pointed toward the ball striking end of the bat barrel.

13. The bat of claim 11, wherein the cone shaped volume is oriented with the apex pointed toward the handle end of the bat barrel.

14. The bat of claim 10, wherein the geometrically shaped volume occupied by the particles is a truncated cone.

15. The bat of claim 2, wherein said weight load is rigid with the bat and balanced about a longitudinal axis of the bat barrel to prevent inertial torque forces occurring when a ball is struck by the ball hitting zone.

16. The method of forming a hollow metal bat consisting of the steps of forming a hollow one-piece bat barrel with a ball striking zone adjacent a closed outer end of the bat barrel and a hand gripping zone adjacent an inner end of the bat barrel and incorporating a concentrated weight load internally of the bat barrel with the inner end of the weight load being spaced outwardly from the ball hitting zone to prevent the weight load from interfering with flexing of the wall of the bat barrel in the ball hitting zone when the bat strikes a ball in the ball hitting zone to obtain maximum ball velocity and distance, said step of incorporating the concentrated weight load internally of the bat barrel including the steps of leaving the inner end of the bat barrel open, and inserting the concentrated weight load through the open inner end of the bat barrel, orienting the concentrated weight load in the outer end of the bat barrel in spaced relation to the ball striking zone.

17. The method as defined in claim 16 wherein said step of inserting the concentrated weight load includes the step of inserting a volume of hardenable material and heavy particles through the open end of the bat barrel when the hardenable material is in a flowable state and the bat barrel is in a generally vertical position with the inner end uppermost to flow the hardenable material and heavy particles to the outer end of the bat barrel, permitting the hardenable material to harden with the heavy particles dispersed therein and closing the inner end of the bat barrel.

18. The method as defined in claim 17 wherein the steps of inserting the hardenable material and heavy particles into the inner end of the bat barrel and flowing the hardenable material and heavy particles to the closed outer end of the bat barrel includes the step of dispersing the heavy particles in a balanced pattern about a longitudinal axis throughout the volume of the hardenable material.

19. The method as defined in claim 18 wherein the step of inserting a volume of hardenable material and heavy particles through the open inner end of the bat barrel includes the step of selecting a total volume of hardenable material and heavy particles to orient an inner end of the hardened material with heavy particles dispersed therein in spaced relation to the ball hitting zone of the bat barrel and spaced inwardly of the closed end of the bat barrel.

* * * * *